US006547637B1

(12) United States Patent
Zhang

(10) Patent No.: US 6,547,637 B1
(45) Date of Patent: Apr. 15, 2003

(54) CHEMICAL/MECHANICAL POLISHING ENDPOINT DETECTION DEVICE AND METHOD

(75) Inventor: Fu Zhang, Austin, TX (US)

(73) Assignee: Momentum Technical Consulting Inc., Austin, TX (US)

( * ) Notice: Subject to any disclaimer, the term of this patent is extended or adjusted under 35 U.S.C. 154(b) by 0 days.

(21) Appl. No.: 09/679,836

(22) Filed: Oct. 5, 2000

(51) Int. Cl.[7] ..... B24B 1/00

(52) U.S. Cl. ..... 451/5; 451/10; 451/41; 451/285; 451/288

(58) Field of Search ..... 451/41, 5, 10, 451/11, 285, 288, 287; 438/692.694; 702/57

(56) References Cited

U.S. PATENT DOCUMENTS 5,308,438 A * 5/1994 Cote et al. ..... 156/636
5,337,015 A * 8/1994 Lustig et al. ..... 324/671
5,667,424 A * 9/1997 Pan ..... 451/6
5,876,265 A * 3/1999 Kojima ..... 451/10
5,904,609 A * 5/1999 Fukuroda et al. ..... 451/8
6,106,662 A * 8/2000 Bibby et al. ..... 156/345
6,159,073 A * 12/2000 Wiswesser et al. ..... 451/6
6,254,453 B1 * 7/2001 Li et al. ..... 451/8
6,257,953 B1 * 7/2001 Gitis et al. ..... 451/5
6,293,845 B1 * 9/2001 Clark-Phelps ..... 451/5
6,327,540 B1 * 12/2001 Miyano et al. ..... 702/57
6,361,646 B1 * 3/2002 Bibby et al. ..... 156/345

* cited by examiner

*Primary Examiner*—George Nguyen
(74) *Attorney, Agent, or Firm*—Jackson Walker LLP; Robert C. Klinger

(57) ABSTRACT

A device (28) and method for detecting endpoints (Ep1, Ep2) of a chemical-mechanical polishing (CMP) process for semiconductor wafers (14). A carrier current signal driving a polishing carrier motor is received and detected, the carrier current signal is modified, and the modified carrier current is analyzed to detect at least one endpoint of the polishing process. The device (28) includes a detector (40), a logic circuit (42) and storage (44).

15 Claims, 3 Drawing Sheets

CHEMICAL/MECHANICAL POLISHING ENDPOINT DETECTION DEVICE AND METHOD

TECHNICAL FIELD

This invention relates generally to semiconductors, and more particularly to a method for determining endpoints in a chemical/mechanical process.

BACKGROUND OF THE INVENTION

The demand for smaller, more compact consumer electronics has created a need to manufacture complex integrated circuits (ICs) having a large number of transistors packed into smaller and smaller areas. This IC miniaturization trend has led to IC designs having increasingly greater device densities. Device densities for conventional ICs are approximately 8 million transistors per square centimeter and will likely exceed 80 million by the year 2012, for example. Device densities of this magnitude require multiple layer IC designs that utilize multiple levels of metal interconnect and dielectric layers.

Dielectric layers are used between component layers to electrically insulate devices from other layers. Multiple level interconnects are typically used within the dielectric layers to provide communication between device elements within a single layer and between devices residing on different layers. ICs having up to six levels of interconnects for complex logic chips are currently in production, and the use of nine layers or more is anticipated. ICs with small compact dimensions pose many manufacturing challenges.

SUMMARY OF THE INVENTION

The present invention achieves technical advantages as a fast, automatic and accurate endpoint detection device and method. A carrier current signal of a motor arm driving a rotating polishing carrier is analyzed to determine significant statistical characteristic changes, in particular, the ratio of standard deviation and mean value of the carrier current signal. When a threshold value is exceeded, an endpoint is detected.

Advantages of the invention include providing a real time endpoint detection with robust algorithms that are effective with a variety of different types of wafers. The invention includes a dynamic feature extraction to minimize human interference and reduce the number of system parameters input. More than one endpoint may be detected for different control targets.

BRIEF DESCRIPTION OF THE DRAWINGS

The above features of the present invention will be more clearly understood from consideration of the following descriptions in connection with accompanying drawings in which.

Corresponding numerals and symbols in the different figures refer to corresponding parts unless otherwise indicated.

DETAILED DESCRIPTION OF PREFERRED EMBODIMENTS

A prior art process for polishing thin metal and oxide layers (normally less than 0.5 mm) is known as chemical mechanical polishing (CMP). Advanced technologies at 0.25 micron and below require CMP to form shallow trench isolation structures between devices. Metal CMP is required for via as well as advanced copper interconnects. To achieve dimensions below 0.07 microns, CMP will be crucial to the formation of true three-dimensional stacked IC's.

A challenging issue when utilizing CMP is endpoint detection, which is the point at which the removal of undesired material has been completed, and the polishing should be discontinued. There are many problems with endpoint detection methods of the prior art, which include optical reflection, thermal detection and friction-based techniques, for example. The process parameters of prior art CMP endpoint detection must be changed to accommodate different wafer materials; otherwise, the endpoint detection may fail to find the endpoint. There are many system parameters that must be determined and frequently changed manually by the operator. Some CMP methods are quite expensive, requiring sensing devices such as infrared or other optical sensing devices. Prior art CMP methods are slow and utilize time-consuming algorithms, for example, high order filtering, which may lead to loss of detection accuracy and a delay in endpoint detection.

Figure 1:
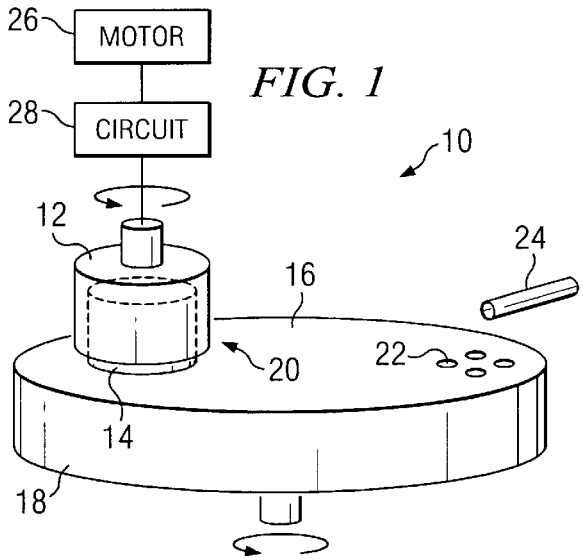
FIG. 1 illustrates a 3-D view of a model of the chemical mechanical polishing device and method of the present invention.

The present invention provides a device and method for determining the endpoints of a CMP process by analyzing the statistical characteristics of the measured carrier current signal. FIG. 1 illustrates an exemplary embodiment of the best mode of the present invention. Shown is a model illustrating the CMP environment 10 in which the present invention is utilized. CMP is often used in semiconductor processing to remove oxide and metal (e.g. tungsten and copper) materials, leaving a planar surface on a semiconductor wafer. A rotating carrier spindle 12 holds the semiconductor wafer 20 through back pressure with the active surface facing down. A rotating porous polishing pad 16 glued onto the top surface of the platen 18 transfers mechanical force to the wafer 14 surface being polished. A slurry 22 of colloidal particles suspended in an aqueous solution is fed through tube 24 onto the pad 16 during polishing. The slurry 22 produces a chemical interaction with the wafer 14 surface and mechanical interaction through abrasives present in the slurry 22 chemistry. Abrasives in the slurry 22 are used to transfer mechanical energy to the surface during polishing. During polishing, the wafer surface is abraded by two mechanisms; chemical through interaction with the slurry 22 and mechanical through force exerted by the pad 16 and silica particles.

Figure 2:
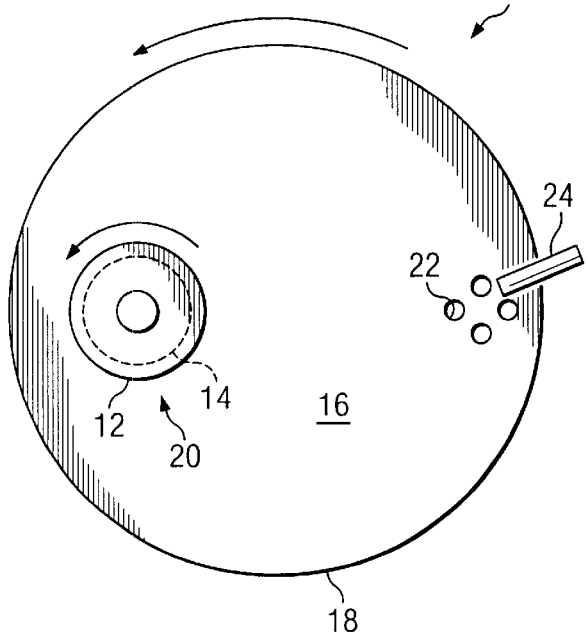
FIG. 2 illustrates a top view of a model of the chemical mechanical polishing device and method shown in FIG. 1.

The present novel endpoint detector circuit device 28 is coupled between motor 26 and rotating spindle 12 to monitor the current drawn by the spindle 12 during the CMP process to detect an endpoint in accordance with the present invention. FIG. 2 shows a top view of the model shown in FIG. 1, with an indication of a possible direction of rotation of the spindle 12 and the rotating platen 18, although other combinations of rotational directions are possible.

Figure 3:
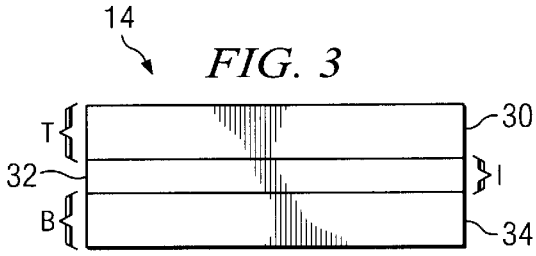
FIG. 3 illustrates a cross-sectional view of a semiconductor wafer to be polished having three distinct regions defined by the inventor.

FIG. 3 shows a cross-sectional diagram of a work piece, or wafer 14. Wafer 14 is composed of two layers of different materials, a top layer 30 and a bottom layer 34, with an interface region 32 disposed therebetween. In a CMP operation, the top layer 30 is to be polished or removed to leave the bottom layer 34 remaining on the wafer 14. In most wafers, the interface region 32 between top layer 30 and bottom layer 34 comprises an uneven surface, which may result in some over-polish of the bottom layer 34 during CMP. Thus, the entire polishing process can be divided into three regions: a top region T where only top layer 30 material is polished, a transient region where both layers (in the transient region 32 of the wafer 14) are polished, and a bottom region B where only bottom layer 34 material is polished. A first endpoint Ep1 of the CMP process is defined as point when polishing process enters into the transient region 32 of the wafer 14.

Figure 4:
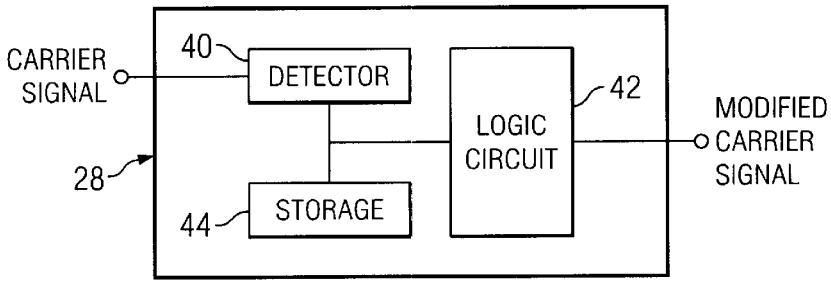
FIG. 4 shows a diagram of the endpoint detector circuit device having a detector, a logic circuit and storage.

FIG. 4 shows a block diagram of the endpoint detector circuit device 28 of the present invention, having a detector 40 to sense the current drawn by motor 26, a processor or logic circuit 42 that processes the information obtained from the motor current, and storage 44 for storing the information obtained. The carrier signal, or current signal from the motor 26, is input to the detector 40, and a modified carrier signal is output from the logic circuit 42. Details of the processing and analysis of the carrier current signal are discussed further herein.

Figure 5:
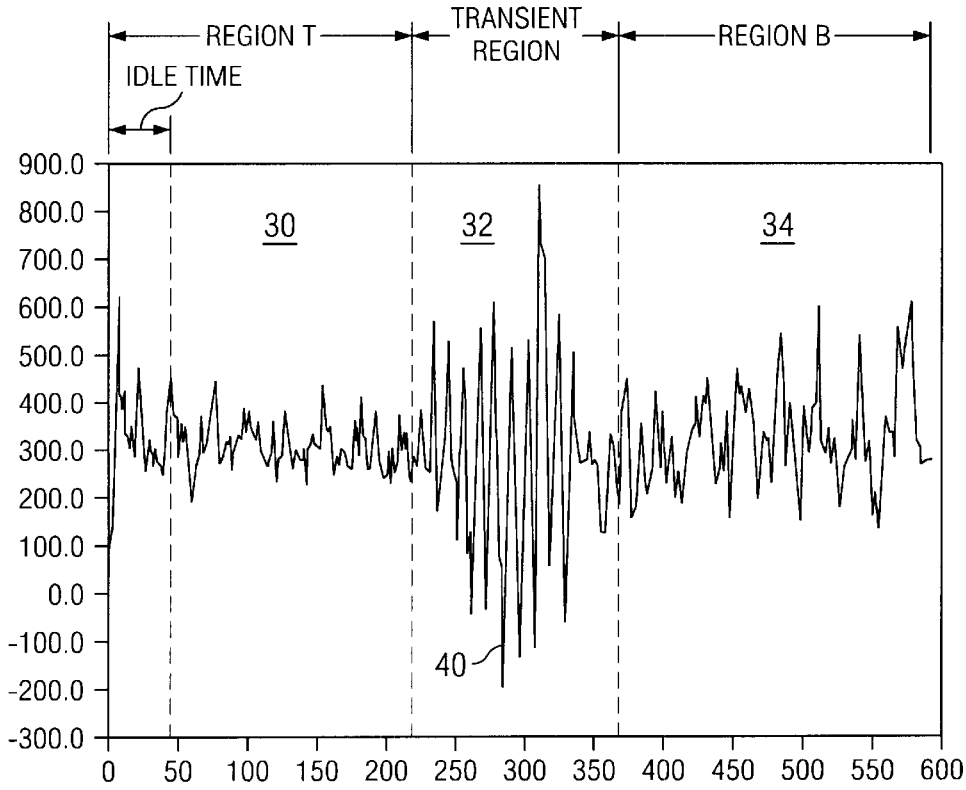
FIG. 5 illustrates a type A carrier current signal having three regions, region T, a transient region and region B correlating to the three semiconductor wafer regions.

In accordance with the present invention, current drawn by the motor 26 that drives the carrier spindle 12 is measured with the endpoint detection device 28. FIG. 5 shows an unfiltered carrier current signal at 40. For most wafers, the carrier current signal 40 may be roughly divided into three regions, corresponding to the three wafer regions defined above for the top region 30, transient region 32 and bottom region 34.

Figure 6:
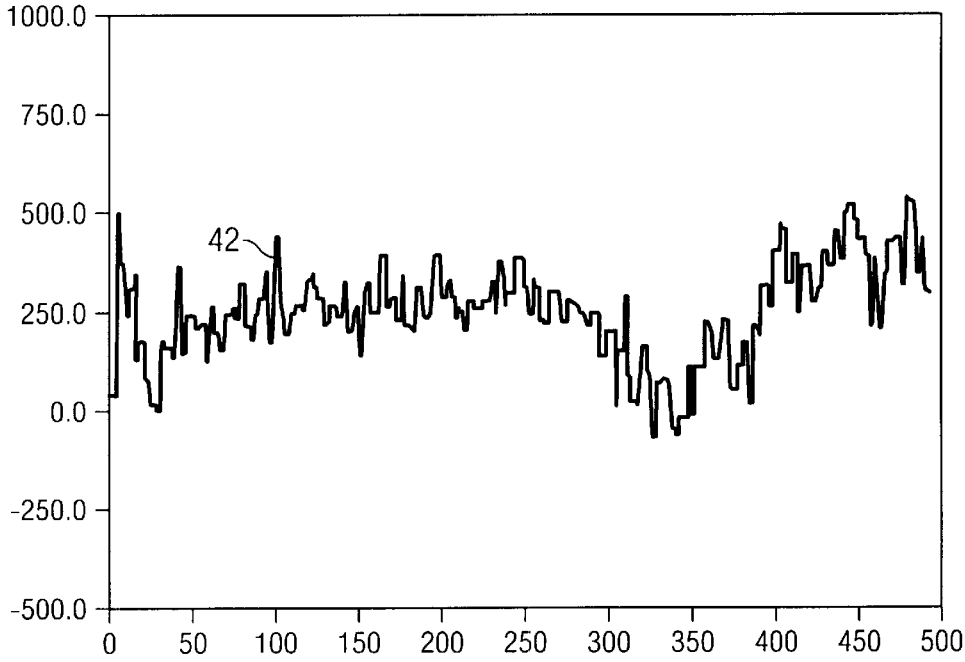
FIG. 6 shows a type B carrier current signal having no distinguishable regions in the semiconductor wafer.

A problem with prior art CMP endpoint detection methods that monitor the carrier current signal is that sometimes the difference between the three regions 30, 32 and 34 of the carrier signal are not as obvious as shown in FIG. 5. FIG. 6 shows a carrier current signal at 42 of such a wafer, having no distinctive differences in the signal 42 between the top region 30, transient region 32 and bottom region 24. In accordance with the present invention, the difference between the three regions is quantified and amplified, so that carrier current signals may be used to find endpoints for virtually every type of semiconductor wafer.

The present invention makes use of the heretofore unrecognized phenomena that some changes in the statistic characteristics of the measured carrier signal change greatly when the polishing tool reaches the end of the top region 30. In accordance with the present invention, the following steps are used to quantify and amplify the carrier current signal differences and find the endpoint or endpoints. First, a baseline threshold is determined. In most cases, the time need to finish polishing region T, noted as $T_t$ is roughly known before polishing begins. An"idle" time is defined as $T_{idle}$=K1*$T_t$, where K1 is an adjustable variable, where typically, initially the value of K1 is around 0.7. The objective of defining the idle time is to use data collected before idle time to calculate a baseline value for the endpoint detection: thus, a threshold baseline value can be determined dynamically in real time. Assuming that"y" represents the data set collected, Y=y(O:$N_{idle}$) is the data collected until idle time is reached. Then the threshold is equal to std(Y)/mean(Y), where std(Y) is the standard deviation of Y and mean(Y) is the mean value of Y.

Figure 7:
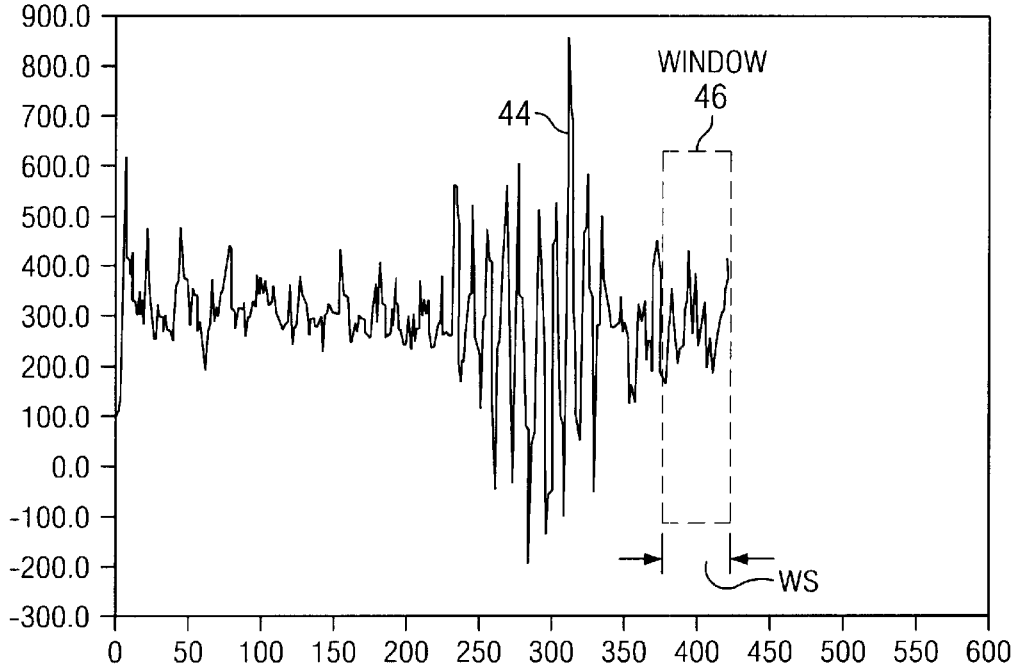
FIG. 7 illustrates collecting data in a window of the carrier current signal.

The next step includes the following. When the polish time T is greater than the idle time $T_{idle}$, the following transform is used: let n denote the number of samples at time T, and the data collected so far is x(1:n), as shown in FIG. 7. Define a window 46, where the window size WS is equal to:

$$WS = \text{endpoint time accuracy} * \text{samples/second.}$$

Then, defining z=x(n−WS,n), where x is the data collected up to time T, where z represents the data set of current window. Note that the window data is calculated successively and represents history data of the carrier current signal.

Figure 8:
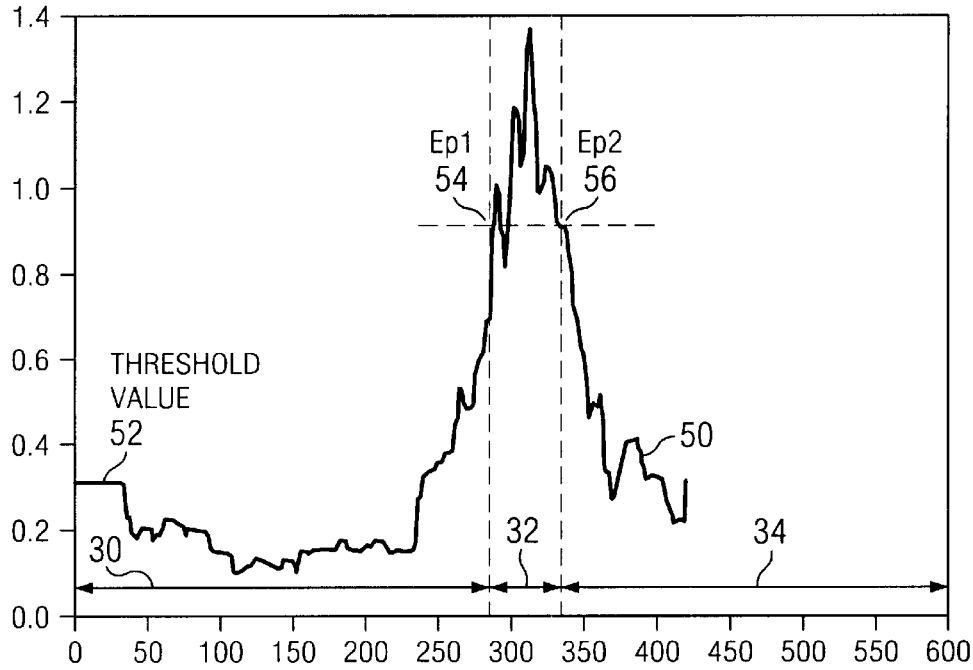
FIG. 8 shows a data curve after a transfer is applied in accordance with the present invention.

Next, a transfer is defined, where T(z)=a threshold when T<idle time and T(z)=std(z)/mean(z) when T>idle time. The curve of the function T(z) is shown in FIG. 8 generally at 50. The function t(z) exhibits the three wafer regions 30, 32, and 34, with the differences between the regions being distinctive.

The polishing process enters the transient region 32 when the first endpoint Ep1 is reached: when $$\text{abs}\left(\left(T(z)-\text{threshold}\right)/\text{threshold}\right) > K2$$

$$\text{and } Ep1 = \text{time when above formula is satisfied}$$

where K2 is an adjustable variable and Ep1 is the time the first endpoint is reached. Typically, variable K2=(2–3) for a CMP application. "Abs" represents "absolute value". The time Ep1 is indicated in the graph 50 of FIG. 8.

The polishing process exits the transient region 32 when Ep2 is found:

$$Ep2 \text{ is the time when abs}\left(\left(T(z)-\text{threshold}\right)/\text{threshold}\right) < K2 \text{ is satisfied.}$$

The time the second endpoint Ep2 is reached is indicated on graph 50 of FIG. 8.

Note that the first endpoint Ep1 may be chosen as the endpoint, for example, if over-polish of the bottom region 34 is undesired, or if another fine-polish process will be performed after this process and some residue (e.g. in the transient region 32) is needed. Alternatively, the second endpoint Ep2 may be chosen as the endpoint, for example, if minimizing re-polishing is the desired goal (e.g. when testing, or when the material on the top-most layer is not cleaned).

A final optional step is the polishing of the bottom layer 34. However, if the first endpoint Ep1 is chosen, this optional step is not performed.

EXAMPLE

A more detailed example of an embodiment of the present algorithm follows. Essentially the present invention involves taking a ratio of the standard deviation of the running windowed points (FIG. 7, window 46) to the standard deviation of the idle points. Using this ratio provides a wafer type-independent solution due to the initial calculation during the idle time.

The calculation may be simplified by the following expressions:

*N*: number of sampling points in window *WS*

*D*: number of sampling points from Time=0 to Time=$T_{idle}$ mentioned above (Standard deviation of last N points/Mean of last N points)=X; and (Standard Deviation of D idle points/Mean of D idle points))=Y where Y is the threshold value mentioned above When abs ((X−Y)/Y))>K2, then an Ep1 endpoint is detected, as shown in FIG. 8.

Thus, the multiplier K2 reveals how many times larger the standard deviation of the windowed points must be than the standard deviation of the idle points. The three configurable variables for the present endpoint detection device 28 and method are N, D, and K2. If K2 is properly chosen, for example, set to a value of 2, then variables N and D may be fixed variables, resulting in an operator only needing to input one parameter (namely, K2), which is advantageous in that it saves time and reduces the chances of operator error. Preferably, the variable K2 is determined dynamically and thus it is recipe-independent, advantageous over prior art CMP endpoint detection methods.

The novel device, method and algorithm of the present invention achieves technical advantages as an automatic, robust, cheap, accurate, fast, flexible, real-time endpoint detection method which detects the endpoints of a multi-layer semiconductor wafer polishing process. The present invention determining CMP endpoints by finding the significant changes of the statistic characters of the measured signal, e.g. when the mean/standard deviation exceed a threshold value. The idle time is defined, and a threshold value is dynamically determined from carrier current signal data collected before the idle time, which minimizes user interference. A transfer method or filtering method is used, so that the differences between semiconductor wafer regions 30, 32 and 34 may be quantified and amplified. The present invention also provides a standard to find at least two endpoints for different process control objects.

While the invention has been described with reference to illustrative embodiments, this description is not intended to be construed in a limiting sense. Various modifications in combinations of the illustrative embodiments, as well as other embodiments of the invention, will be apparent to persons skilled in the art upon reference to the description. For example, the invention described herein is preferably implemented in hardware, but may be implemented in software as well. It is therefore intended that the appended claims encompass any such modifications or embodiments.

What is claimed is:

1. An endpoint detector for use in a polishing apparatus of the type having an electric motor that rotates a polishing carrier relative to an item to be polished, the detection device comprising;

a detector for receiving and detecting the motor current signal; and a logic circuit for (a) establishing a baseline current signal threshold, (b) defining a time window of the current signal, (c) calculating the standard deviation of the current signal within said window, calculating the mean of the current signal within said window, and calculating the ratio of said standard deviation to said mean; and (d) analyzing the ratio to detect at least one endpoint, Ep1 or Ep2, of the polishing.

2. An endpoint detection device according to claim 1, wherein said logic circuit defines the first endpoint, Ep1, when:

$$\text{abs}((T(z)-\text{threshold})/\text{threshold})>K2,$$

where K2 is an adjustable variable, "abs" means absolute value, and z=x(n−WS,n), where x is the current signal data collected up to a time T, WS is the window size in units of time, and n is the number of samples of the current signal taken by said time T.

3. An endpoint detection device according to claim 2, wherein said logic circuit defines the second endpoint, Ep2, when:

*Ep*1 has been defined, and $$\text{abs}((T(z)-\text{threshold})/\text{threshold})<K2.$$

4. A method of detecting an endpoint of a polishing process which is effected by an electric motor rotating a polishing carrier relative to an item to be polished, which method comprises:

(a) receiving and detecting the motor current signal;

(b) establishing a baseline current signal threshold;

(c) calculating the standard deviation of the current signal within a time window;

(d) calculating the mean of the current signal within said window;

(e) determining the ratio of said standard deviation to said mean; and (f) analyzing the ratio to detect an endpoint of the polishing.

5. A method according to claim 4 further comprising defining a first endpoint, Ep1, when:

$$\text{abs}((T(z)-\text{threshold})/\text{threshold})>K2,$$

where K2 is an adjustable variable, "abs" means the absolute value, z=x(n−WS,n) where x is the current signal data collected up to a time T, WS is the window size in units of time, and n is the number of samples of the current signal taken by time T.

6. A method according to claim 5 further comprising defining a second endpoint as the time when

*Ep*1 has been defined and $$\text{abs}((T(z)-\text{threshold}/\text{threshold})<K2.$$

7. An algorithm for detecting endpoints of a semiconductor wafer chemical-mechanical polishing (CMP) process, comprising:

receiving and detecting a current signal driving a polishing carrier motor;

establishing an endpoint baseline threshold level;

calculating the standard deviation of the current signal within a time window;

calculating the mean of the current signal within said window;

determining a modified current signal by calculating the ratio of said standard deviation to said mean; and analyzing the ratio to detect at least one endpoint of the polishing process.

8. An algorithm according to claim 7 wherein said establishing a baseline endpoint threshold is performed during as idle period of the polishing process.

9. An algorithm according to claim 8 further comprising amplifying the carrier current signal.

10. An algorithm according to claim 9 further comprising defining a first endpoint, Ep1, when $$\text{abs}((T(z)-\text{threshold})/\text{threshold})>K2,$$

where K2 is an adjustable variable, "abs" means the absolute value, z=x(n−WS,n) where x is the current signal data collected up to a time T WS is the window size in units of time, and n is the number if samples of the current signal taken by time T.

11. An algorithm according to claim 10 further comprising defining as a second endpoint, Ep2, the value assumed by the current signal when $Ep1$ has been defined and $$\text{abs}((T(z)-\text{threshold})/\text{threshold})<K2.$$

12. In a polishing process which is effected by an electric motor rotating a polishing carrier relative to a first layer residing on top of a layer, the layers defining an irregular interface therebetween, the polishing initially removing the first layer and then reaching the interface to remove increasingly larger portions of the second layer as it is exposed at the interface, a method of determining when polishing of the interface begins, which method comprises:

(a) determining a threshold baseline value Y by calculating for a selected time during polishing of the first layer before the interface is reached the ratio of (1) the standard deviation of the motor current (2) the mean value of the motor current;

(b) following determination of the value of Y, determining successive values of X, by calculating during successive time intervals of the same selected duration the ratio of (1) the standard deviation of the motor current to (2) the mean value of the motor current for each value of X determine if $$[(X-Y)/Y]>K,$$

where K is a selected quantity, a negative determination indicating that polishing of the interface has not begun and a positive determination indicating that polishing of the interface has begun.

13. A method as in claim 12, wherein:

polishing is terminated when the determination is positive.

14. A method as in claim 12, which further comprises:

continuing polishing after a positive determination has been made and continuing to determine successive values of X, and for each value of X determine if $$[(X-Y)/Y]<K,$$

a negative determination indicating that polishing of the interface continues and a positive determination indicating that only the second layer is being polished.

15. A method as in claim 14, wherein:

polishing is terminated when the determination is positive.

* * * * *